US011964189B2

(12) United States Patent
Kao et al.

(10) Patent No.: US 11,964,189 B2
(45) Date of Patent: Apr. 23, 2024

(54) TRAINING DEVICE WITH ADJUSTABLE RESISTANCE

(71) Applicant: Wistron Corporation, New Taipei (TW)

(72) Inventors: Chuan-Yen Kao, New Taipei (TW); Yao-Tsung Chang, New Taipei (TW); Chih-Yang Hung, New Taipei (TW)

(73) Assignee: WISTRON CORPORATION, New Taipei (TW)

( * ) Notice: Subject to any disclaimer, the term of this patent is extended or adjusted under 35 U.S.C. 154(b) by 283 days.

(21) Appl. No.: 17/090,962

(22) Filed: Nov. 6, 2020

(65) Prior Publication Data

US 2022/0080264 A1 Mar. 17, 2022

(30) Foreign Application Priority Data

Sep. 15, 2020 (TW) ..... 109131762

(51) Int. Cl.

*A63B 24/00* (2006.01)
*A63B 21/005* (2006.01)
*A63B 21/012* (2006.01)

(52) U.S. Cl.

CPC ..... *A63B 24/0087* (2013.01); *A63B 21/005* (2013.01); *A63B 21/012* (2013.01);
(Continued)

(58) Field of Classification Search

CPC ..... A63B 24/0087; A63B 24/0062; A63B 24/0003; A63B 2024/0093; A63B 21/00065; A63B 21/00058; A63B 21/005; A63B 21/012; A63B 21/225; A63B 21/0056; A63B 22/0605; A63B 69/16; A63B 2220/13; A63B 2220/30; A63B 2220/50; A63B 2220/34; A63B 2220/51;
(Continued)

(56) References Cited

U.S. PATENT DOCUMENTS 5,720,711 A 2/1998 Bond et al.
5,993,356 A 11/1999 Houston et al.
(Continued)

FOREIGN PATENT DOCUMENTS

AU 2014397779 B2 * 1/2018 ..... A63B 21/063
CN 100360375 C 1/2008
(Continued)

OTHER PUBLICATIONS

Translation of Chen, TW 2020/31318 A (Year: 2020).*
(Continued)

*Primary Examiner* — Megan Anderson
*Assistant Examiner* — Sara K. Conway
(74) *Attorney, Agent, or Firm* — McClure, Qualey & Rodack, LLP

(57) ABSTRACT

A training device includes a force receiving component, a location detector, a resistance generator, and a controller. The force receiving component moves along a closed trajectory. The location detector is configured to detect a location of the force receiving component in the closed trajectory and to output a location signal. The resistance generator is configured to exert a resistance on the force receiving component. The controller controls the resistance generator to adjust the resistance based on the location signal.

14 Claims, 12 Drawing Sheets

(52) U.S. Cl.
CPC ..... *A63B 24/0003* (2013.01); *A63B 24/0062* (2013.01); *A63B 2024/0093* (2013.01); *A63B 2220/13* (2013.01); *A63B 2220/30* (2013.01); *A63B 2220/50* (2013.01); *A63B 2230/045* (2013.01)

(58) Field of Classification Search
CPC ..... A63B 2220/54; A63B 2220/10; A63B 2220/24; A63B 2220/80; A63B 2220/805; A63B 2230/045
See application file for complete search history.

(56) References Cited

U.S. PATENT DOCUMENTS

| | | | | |
|---|---|---|---|---|
| 6,027,429 | A | 2/2000 | Daniels | |
| 7,764,990 | B2 * | 7/2010 | Martikka | A61B 5/222 607/48 |
| 9,283,434 | B1 | 3/2016 | Wu | |
| 10,369,416 | B2 * | 8/2019 | Huang | A63B 21/0051 |
| 10,722,745 | B2 * | 7/2020 | Tong | A63B 22/0694 |
| 2009/0011907 | A1 * | 1/2009 | Radow | B62M 3/00 482/57 |
| 2011/0195819 | A1 * | 8/2011 | Shaw | A63B 24/0087 482/5 |
| 2018/0214729 | A1 * | 8/2018 | Rubin | A63B 24/0087 |
| 2019/0099633 | A1 | 4/2019 | Orady et al. | |
| 2019/0192914 | A1 * | 6/2019 | Langford | A63B 21/00196 |
| 2020/0289045 | A1 * | 9/2020 | Hacking | A63B 21/00181 |
| 2020/0289889 | A1 * | 9/2020 | Hacking | A63B 21/00072 |

FOREIGN PATENT DOCUMENTS

| | | | | |
|---|---|---|---|---|
| CN | 104826230 | A | | 8/2015 |
| CN | 207012482 | U | | 2/2018 |
| CN | 110237493 | A | | 9/2019 |
| CN | 110559156 | A | | 12/2019 |
| CN | 110694228 | A | | 1/2020 |
| CN | 110772758 | A | | 2/2020 |
| TW | 201738542 | A | | 11/2017 |
| TW | 202031318 | A | * | 9/2020 |
| TW | 202031318 | A | | 9/2020 |
| WO | 2016171799 | A1 | | 10/2016 |

OTHER PUBLICATIONS

Examination report dated Mar. 2, 2022, listed in related Taiwan patent application No. 109131762.
Examination report dated Jul. 18, 2022, listed in related China patent application No. 202011122797.4.

* cited by examiner

TRAINING DEVICE WITH ADJUSTABLE RESISTANCE

CROSS-REFERENCE TO RELATED APPLICATION

This non-provisional application claims priority under 35 U.S.C. § 119(a) to Patent Application No. 109131762 in Taiwan, R.O.C. on Sep. 15, 2020, the entire contents of which are hereby incorporated by reference.

BACKGROUND

Technical Field

The present invention relates to a training device, and in particular, to a training device having a resistance generator.

Related Art

Training devices help users achieve the purpose of exercise or fitness. Considering different purposes of use, it is better for the training device to provide a corresponding weight training level for each user. However, not all users have the same physiological conditions. For example, a weight training level suitable for the young adults is different from the weight training level suitable for the elderly. In addition, fitness goals that one user expects to achieve in different training stages may also be different.

To resolve the problem of different fitness goals for different individuals or different training stages, fitness training devices in the market provide training devices of various specifications, such as dumbbells of different weights, or provide fitness devices with an adjustable resistance, such as flywheels. For the latter, users can make their own adjustments according to personal conditions or requirements. However, a resistance adjustment mechanism provided by the existing training device is still insufficient to deal with diversified user conditions. In addition, the resistance of the existing training device can only be adjusted according to the subjective cognition of the user rather than according to the objective physiological conditions of the user.

SUMMARY

In view of this, according to some embodiments, a training device includes a force receiving component, a location detector, a resistance generator, and a controller. The force receiving component moves along a closed trajectory. The location detector is configured to detect a location of the force receiving component in the closed trajectory and to output a location signal. The resistance generator is configured to exert a resistance on the force receiving component. The controller controls the resistance generator to adjust the resistance based on the location signal.

In conclusion, according to some embodiments, the controller changes the resistance outputted by the resistance generator according to the location of the force receiving component. When to-be-trained extremities of a user are at different locations, the training device can provide different resistances. When the extremities are at different locations, the extremities or muscle groups that dominate force application are different. Therefore, the training device can perform intensive training on specific extremities or muscle groups.

DETAILED DESCRIPTION

Figure 1:
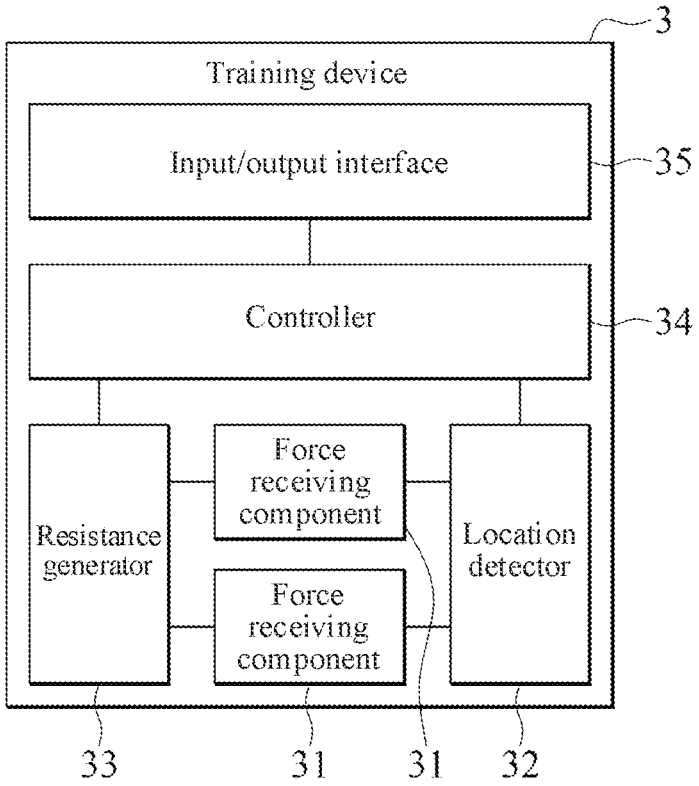
FIG. 1 is a block diagram of a training device according to some embodiments.

FIG. 1 is a block diagram of a training device according to some embodiments. Referring to FIG. 1, according to some embodiments, a training device 3 includes a force receiving component 31, a location detector 32, a resistance generator 33, and a controller 34.

The training device 3 is a training device having a force receiving component 31, for example, but not limited to, a training device 3 applied to hands or feet. In some embodiments, there are two force receiving components 31, and the force receiving components receive forces applied by both hands or feet. For example, the training device may be a flywheel, an exercise bike, a climbing machine, or a weight training machine. In some embodiments, there is a single force receiving component 31, and the force receiving component receives a force applied by a single hand or a single foot. For example, the training device may be a big turning wheel. In some embodiments, the training device 3 is fitness equipment that can be disposed or fixed on the ground and that does not move relative to the ground when being used. In some embodiments, the entire training device 3 may move relative to the ground when being used.

The force receiving component 31 is adapted to bear a force applied by a user. The force receiving component 31 may be, but is not limited to, a pedal, a pull ring, or a grip. In some embodiments, the force receiving component 31 includes a component, for example, the pedal, the pull ring, or the grip, that directly bears the force applied by the user, and a component, for example, a chain, a crawler, a gear set, or a wire, that transfers the force applied by the user. The force receiving component 31 is displaced after bearing the applied force, and moves along a closed trajectory. The displacement is a displacement of rectilinear motion or an angular displacement of rotational motion. The closed trajectory indicates that any component of the force receiving component 31 moves back and forth to same location points during training. In other words, each component of the force receiving component 31 is not displaced in each training cycle, and a moving track of the component is used as the closed trajectory. The closed trajectory may be, but is not limited to, a circle, an irregular loop, or a straight line.

Figure 2A:
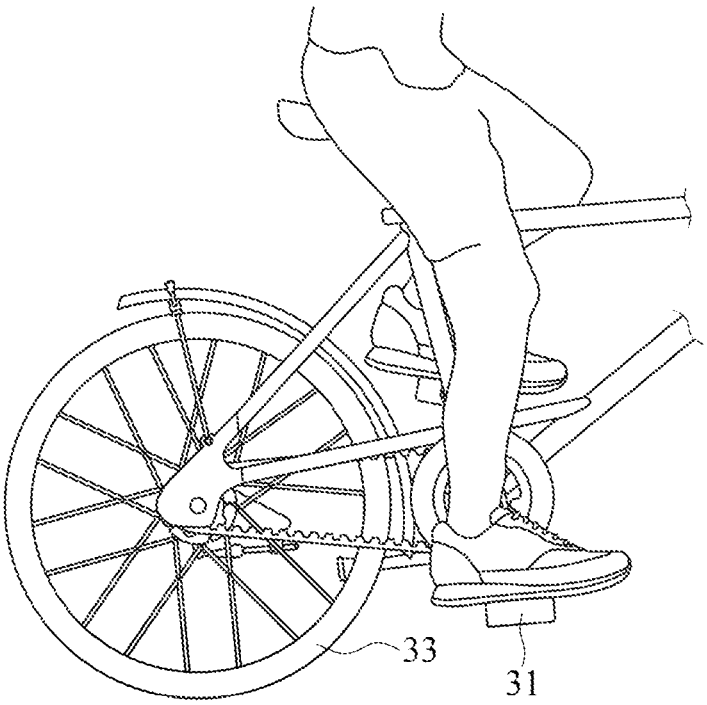
FIG. 2A is a schematic diagram of a use state of a pedal training device.
Figure 2B:
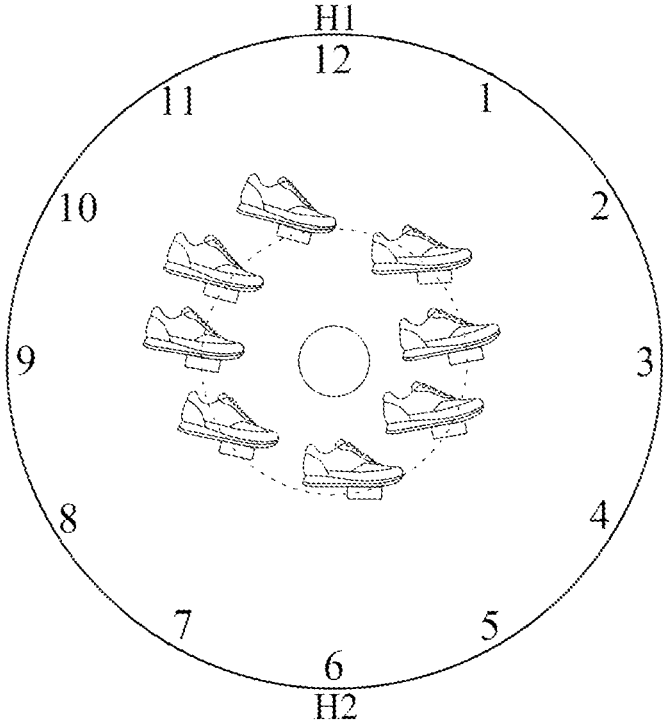
FIG. 2B is a schematic diagram of a pedal location of a pedal training device.
Figure 3:
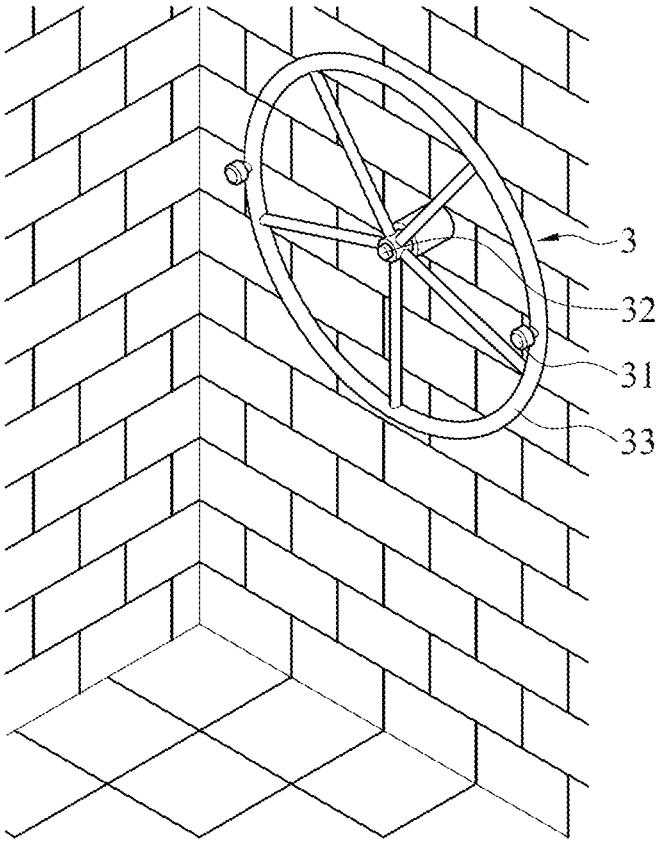
FIG. 3 is a schematic diagram of a use state of a big turning wheel.

FIG. 2A is a schematic diagram of a use state of a pedal training device. FIG. 2B is a schematic diagram of a pedal location of a pedal training device. Referring to FIG. 2A, in some embodiments, the force receiving component 31 includes a pedal that directly bears the force applied by the user, and a gear and a chain that transfer the force applied by the user. When the user is training, each pedal periodically or aperiodically passes through the 12 o'clock location shown in FIG. 2B. Each pedal is displaced after bearing the applied force, and moves along a closed circular trajectory. FIG. 3 is a schematic diagram of a use state of a big turning wheel. In some embodiments, the big turning wheel is used as an example. The big turning wheel has a grip and a turntable. The grip is the force receiving component 31 that directly bears the force applied by the user, and the grip is hinged to a circular surface of the turntable. When the user is training, the grip periodically or aperiodically passes through the 12 o'clock location shown in FIG. 2B. Each grip is displaced after bearing the applied force and moves along a closed circular trajectory.

The closed trajectory may include a plurality of sections. Referring to FIG. 2B, in some embodiments, the closed circular trajectory may be divided into a section from 12 o'clock to 6 o'clock and a section from 6 o'clock to 12 o'clock in the clockwise direction. In other embodiments, the closed circular trajectory may be divided into a section from 12 o'clock to 2 o'clock and a section from 2 o'clock to 12 o'clock in the clockwise direction. In other embodiments, the closed circular trajectory may be divided into a section from 12 o'clock to 2 o'clock, a section from 3 o'clock to 5 o'clock, a section from 6 o'clock to 8 o'clock, and a section from 9 o'clock to 11 o'clock. In other embodiments, the closed circular trajectory may be divided into a plurality of sections, so that each section is approximate to a point.

The resistance generator 33 is configured to exert a resistance on the force receiving component 31. The resistance generator 33 may be, but is not limited to, a load, a spring, an elastic rope, a hydraulic pressure, a gear set, a rough surface (a non-ideal smooth surface with a friction coefficient), a magnetic component, and the like. The resistance generator 33 receives a force transferred by the force receiving component 31. In some embodiments, the resistance generator 33 receives a force transferred by a component of the force receiving component 31 that directly bears the force applied by the user. In other embodiments, the resistance generator 33 receives a force transferred by a component of the force receiving component 31 that transfers the force applied by the user. The resistance generator 33 generates a resistance against the received force transferred by the force receiving component 31, and exerts the resistance on the force receiving component 31. In some embodiments, the resistance may be generated from, but not limited to, a gravity, a gravitational moment, an elastic force, a tension, a friction, an electromagnetic force, and the like.

Referring to FIG. 2A, in some embodiments, the rear wheel is a resistance generator 33 that receives a force transferred by the gear and the chain to generate an angular displacement. When the rear wheel rotates, a gravitational moment resists the angular displacement, so that the rear wheel exerts a resistance on the chain. In addition, if the rear wheel is in contact with a rough surface, a friction resists the angular displacement, so that the rear wheel exerts a resistance on the chain. In some embodiments, the rear wheel is a resistance generator 33 that is made of metal and that is formed by placing a magnet away from the wheel center and close to the wheel body without contacting the wheel body, and the rear wheel receives a force transferred by the gear and the chain to generate an angular displacement. When the rear wheel rotates, according to the Lenz's Law, a magnetic force generated by a change in magnetic flux resists the angular displacement, so that the rear wheel exerts a resistance on the chain.

The location detector 32 is configured to detect a location of the force receiving component 31 in the closed trajectory and to output a location signal. In some embodiments, the location detector 32 is configured to detect a location of the force receiving component 31 in the closed trajectory and to output a location signal based on the location. The location detector 32 may be, but is not limited to, a Hall sensor, an angle sensor, an optical sensor, a laser sensor, a sound wave sensor, a pull-wire displacement meter, a touch switch, and the like. In some embodiments, the location detected by the location detector 32 is a location point relative to the entire closed trajectory. For example, referring to FIG. 2B, the 3 o'clock location is a location point relative to the entire closed circular trajectory. In some embodiments, several location detectors 32 may be disposed on the closed trajectory, and a to-be-detected object 321 is correspondingly disposed on the force receiving component 31. In this way, when a specific detector detects the to-be-detected object 321, the location of the force receiving component 31 may be calculated due to a configuration relationship preset for the detector. In other embodiments, an angle sensor may be disposed at the center of the closed circular trajectory. In this way, when the sensor measures a specific angle, the location of the force receiving component 31 on the circle may be calculated.

Figure 4:
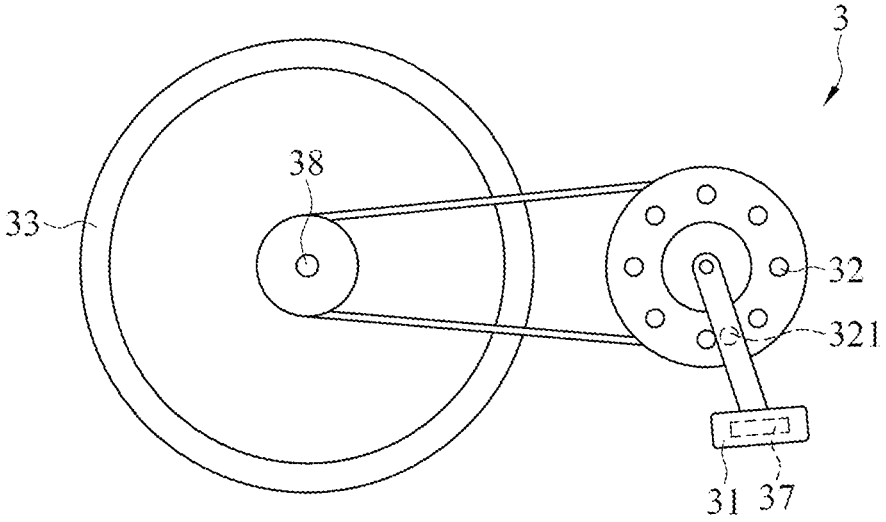
FIG. 4 is a schematic diagram of a location detector of a training device according to some embodiments.

FIG. 4 is a schematic diagram of a location detector of a training device according to some embodiments. In some embodiments, the pedal of the force receiving component 31 moves along a closed circular trajectory. When the pedal moves under force, the gear and the chain are driven to transfer the force to the resistance generator 33. Several location detectors 32 are disposed on the closed circular trajectory, and a to-be-detected object 321 is disposed on the force receiving component 31. The location detector 32 and the to-be-detected object 321 are correspondingly disposed, so that when the force receiving component 31 passes through a specific location detector 32, the location detector 32 can detect the to-be-detected object 321 on the force receiving component 31.

The controller 34 controls the resistance generator 33 to adjust the resistance according to the location of the force receiving component 31. In some embodiments, the closed trajectory includes a plurality of sections, and the controller 34 controls the resistance generator 33 to adjust the resistance according to a section of the location of the force receiving component 31. In some embodiments, different sections may correspond to different resistance parameters. In some embodiments, the controller 34 controls the resistance generator 33 to output a resistance corresponding to the resistance parameter according to the resistance parameter. The generated resistances and resistance parameters are different according to different types of the resistance generator 33. In some embodiments, when the resistance generator 33 is a load, the resistance may be a gravity or a gravitational moment, and the resistance parameter may be a quantity of the loads or a length of an arm of force; when the resistance generator 33 is a spring or an elastic rope, the resistance may be an elastic force, and the resistance parameter may be an elastic constant; when the resistance generator 33 is a gear set, the resistance may be a gravitational moment, and the resistance parameter may be a gear ratio; when the resistance generator 33 is a rough surface, the resistance may be a friction, and the resistance parameter may be a friction coefficient or a positive force; and when the resistance generator 33 is a magnetic component, the resistance may be a magnetic force, and the resistance parameter may be a current amount of an electromagnet or a distance between magnetic components. The magnitude of the resistance parameter may change the magnitude of the resistance, and the magnitude of the resistance parameter is irrelevant to a motion state such as a displacement, a velocity, an acceleration, an angular displacement, an angular velocity, and an angular acceleration of the force receiving component 31.

A manner in which the controller 34 adjusts the resistance generator 33 depends on the type of the resistance generator 33. In some embodiments, the resistance generator 33 is a spring, and the controller 34 increases the quantity of springs connected in parallel to increase the resistance outputted by the resistance generator 33. In some embodiments, the resistance generator 33 is a rough surface, and the controller 34 presses two rough surfaces in the resistance generator 33 to increase the resistance outputted by the resistance generator 33. In some embodiments, the resistance generator 33 is a magnetic component, and the controller 34 increases a current amount of an electromagnet in the resistance generator 33 to increase the resistance outputted by the resistance generator 33.

When the force receiving component 31 moves to a different section, the controller 34 adjusts the resistance generator 33 according to the resistance parameter corresponding to the section, to change the resistance outputted by the resistance generator 33. For example, referring to FIG. 2B, the closed circular trajectory is divided into a section from 12 o'clock to 3 o'clock, a section from 4 o'clock to 5 o'clock, and a section from 7 o'clock to 11 o'clock, and the three sections sequentially correspond to resistance parameters 1, 2, and 3 in the clockwise direction. Assuming that a function relationship between the resistance parameter and the resistance is that the resistance is equal to the resistance parameter multiplied by 10, the foregoing sections sequentially cause the resistance generator 33 to generate a resistance of 10 Newtons, a resistance of 20 Newtons, and a resistance of 30 Newtons. Therefore, when the force receiving component 31 moves to the 12 o'clock location, the controller 34 adjusts the resistance generator 33, so that the resistance generator 33 generates a force of 10 Newtons; when the force receiving component 31 moves to the 4 o'clock location, the controller 34 adjusts the resistance generator 33, so that the resistance generator 33 generates a force of 20 Newtons; and when the force receiving component 31 moves to the 7 o'clock location, the controller 34 adjusts the resistance generator 33, so that the resistance generator 33 generates a force of 30 Newtons.

Referring to FIG. 1, in some embodiments, the location detector 32 detects the force receiving component 31 and generates a detection signal. The controller 34 receives the detection signal from the location detector 32, to determine the location of the force receiving component 31 in the closed trajectory. When the force receiving component 31 moves to a different section, the controller 34 adjusts the resistance generator 33 according to the resistance parameter corresponding to the section, to change the resistance outputted by the resistance generator 33. In this way, when the force receiving component 31 moves to different sections, the same force that the force receiving component 31 exerts on the resistance generator 33 is fed back with different resistances. In some embodiments, the controller 34 may receive a parameter setting made by the user in an input/output interface 35, to adjust a correspondence between sections and resistance parameters. For example, an example in which the user uses the pedal training device in FIG. 2A is used. The input/output interface 35 allows the user to respectively set pedaling sections corresponding to the left foot and the right foot, to obtain resistance parameters corresponding to expected training amounts for the left foot and the right foot. In this way, the training device can more accurately satisfy a training requirement of the user.

Figure 5:
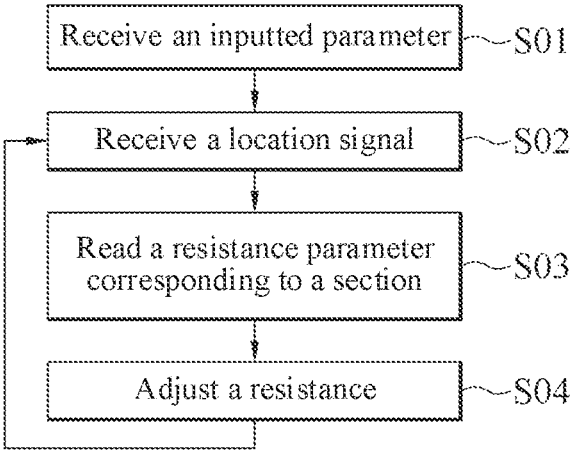
FIG. 5 is a flowchart of resistance adjustment based on a location in a training device according to some embodiments.

FIG. 5 is a flowchart of resistance adjustment based on a location in a training device according to some embodiments. In some embodiments, the controller 34 receives a set parameter inputted by a user (step S01), to adjust a setting of the training device 3. For example, the input/output interface 35 allows a set parameter inputted by the user, to accordingly adjust a correspondence between sections and resistances. For example, the input/output interface 35 allows a physiologically related set parameter inputted by the user, to accordingly adjust an appropriate resistance. The foregoing physiologically related set parameter may be, but is not limited to, age, gender, height, weight, body fat percentage, and the like. After the setting is completed, the controller 34 receives a location signal that is about the force receiving component 31 and that is transmitted by the location detector 32 (step S02). The controller 34 determines a section of a current location of the force receiving component 31, and accordingly obtains a resistance parameter corresponding to the location (step S03). Then, the controller 34 adjusts the resistance generator 33 according to the resistance parameter, to change the resistance outputted by the resistance generator 33 (step S04). After the adjustment is completed, the controller 34 continues to receive the location signal that is about the force receiving component 31 and that is transmitted by the location detector 32 (step S02), to repeat the foregoing steps. In some embodiments, when the controller 34 determines in step S03 that the current location of the force receiving component 31 is in the same section as in the previous loop, the controller 34 may choose to perform step S04 or skip performing step S04, and then returns to step S02 to perform the next loop.

Figure 6:
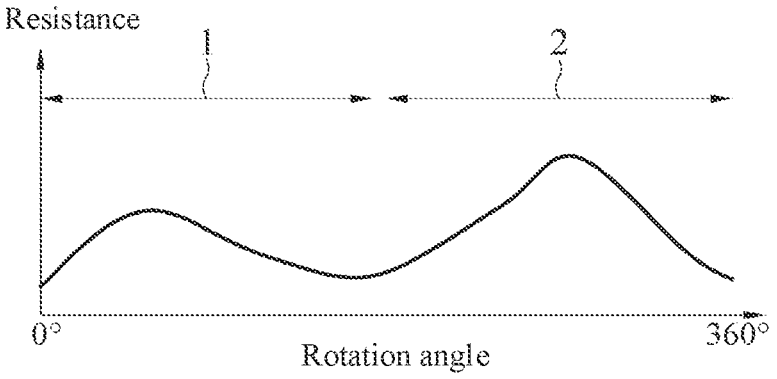
FIG. 6 is a schematic diagram of resistance output of a training device according to some embodiments.

For some users, physiological conditions of body parts being trained at the same time may be different. For example, muscles of left and right extremities of a user are asymmetrically distributed, resulting in a situation that one side is normal and the other side is forceless. In some embodiments, for a user with different physiological conditions of left and right extremities, for example, a user with asymmetrical muscle distribution of the left and right legs, the training device 3 provides different resistance intensities according to different legs that dominate force application. For example, referring to FIG. 2A and FIG. 2B, assuming that only the right foot of the user is insufficient in muscle strength and needs to exercise, it is necessary to increase the resistance during pedaling of the right foot. Therefore, FIG. 2B is used as a closed circular trajectory of the right pedal, and the closed circular trajectory is divided into a section from 12 o'clock to 6 o'clock and a section from 6 o'clock to 12 o'clock in the clockwise direction. Since the section in which the right foot dominates pedaling is from 12 o'clock to 6 o'clock in the clockwise direction, a resistance parameter corresponding to the section is set to be higher; and since the section in which the left foot dominates pedaling is from 6 o'clock to 12 o'clock in the clockwise direction, a resistance parameter corresponding to the section is set to be lower. FIG. 6 is a schematic diagram of resistance output of a training device according to some embodiments. The horizontal axis in FIG. 6 represents a rotation angle of the crank of the pedal training device shown in FIG. 2A, and the longitudinal axis represents the resistance outputted by the resistance generator 33. When the pedal is in the left-foot pedaling section 1, the resistance generator 33 generates a lower resistance; and when the pedal is in the right-foot pedaling section 2, the resistance generator 33 generates a higher resistance. In this way, the user can enhance training for a specific extremity.

Referring to FIG. 2A and FIG. 2B, when the foot of the user applies a force on the pedal, the pedal generates a moment relative to the center of the closed circular trajectory. When the pedal is at the 12 o'clock location, because the user applies the force downward, this point has the smallest moment relative to the center; and when the right pedal is at the 3 o'clock location, because the user applies the force downward, this point has the largest moment relative to the center. Therefore, when the applied forces are the same, moments generated at different locations are different. In some embodiments, the training device 3 of the present invention provides different resistance intensities according to different locations of the force receiving component 31. A section with a lower applied force moment corresponds to a lower resistance parameter, and a section with a higher applied force moment corresponds to a higher resistance parameter, so that a compensation for resistance feedback is given at different points of force application.

Figure 7A:
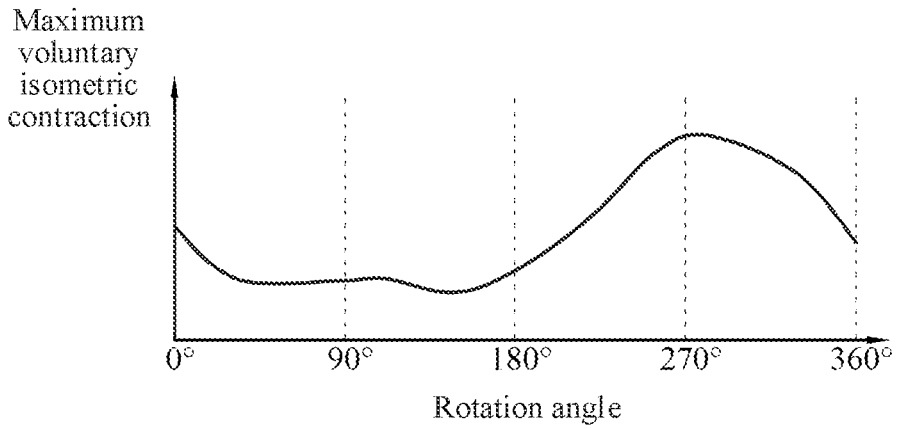
FIG. 7A is a schematic diagram of a relationship between a pedal location of a pedal training device and contraction of the rectus femoris.
Figure 7B:
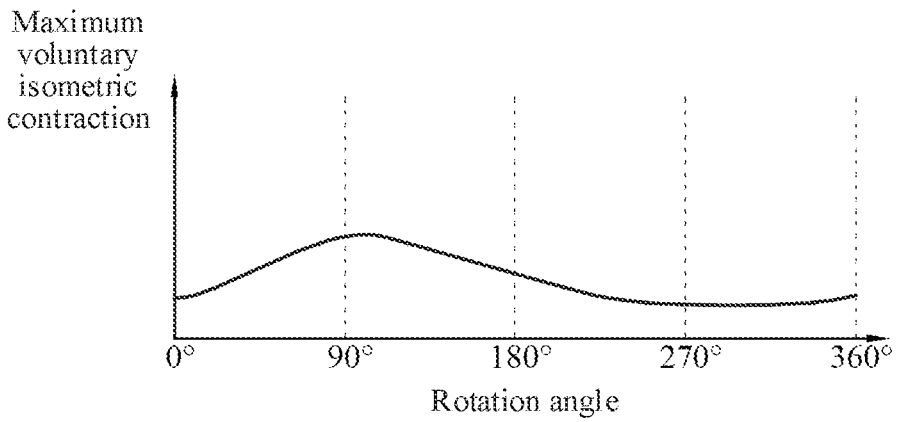
FIG. 7B is a schematic diagram of a relationship between a pedal location of a pedal training device and contraction of the medial gastrocnemius.

For some users, there may be a key muscle group that is expected to be intensively trained during single training. For example, the user expects to only intensively train the rectus femoris during a foot training process. It is learned in the previous research that in a process of pedaling a bicycle, muscle groups that dominate force application are different when the pedal is at different rotation angles (Lopes, Alexandre Dias, et al., 2014, IJSPT). FIG. 7A is a schematic diagram of a relationship between a pedal location of a pedal training device and contraction of the rectus femoris. FIG. 7B is a schematic diagram of a relationship between a pedal location of a pedal training device and contraction of the medial gastrocnemius. Referring to FIG. 2B, for ease of description, it is assumed that the angle of the pedal crank is 0 at the 12 o'clock location. FIG. 7A and FIG. 7B respectively show a relationship between a maximum isometric contraction of the rectus femoris and the rotation angle of the pedal crank, and a relationship between a maximum isometric contraction of the medial gastrocnemius and the rotation angle of the pedal crank. The horizontal axis in FIG. 7A and FIG. 7B represents the rotation angle of the crank of the pedal training device shown in FIG. 2A, and the longitudinal axis represents the maximum voluntary isometric contraction force of the muscle. When the angle of the pedal crank is 270, the rectus femoris located on the front side of the thigh generates the maximum contraction force. When the angle of the pedal crank is 90, the medial gastrocnemius located on the posterior medial side of the thigh generates the maximum contraction force. In some embodiments, the training device 3 provides different resistance intensities according to different locations of the force receiving component 31. A section in which a muscle group that the user intends to train dominates force application corresponds to a higher resistance parameter, to provide the muscle group with a higher training intensity.

In some embodiments, the training device 3 includes a memory, and a lookup table is stored in the memory. The lookup table is used for recording a correspondence between resistance parameters and sections. The controller 34 can read the memory to access the lookup table, read the resistance parameter corresponding to each section according to the lookup table, and then adjust the resistance outputted by the resistance generator 33. The lookup table may have been stored in a built-in or external memory of the training device 3 when the training device 3 is at delivery, or the user may input a set parameter to create the lookup table, and then store the lookup table in the built-in or external memory of the training device 3.

Figure 8A:
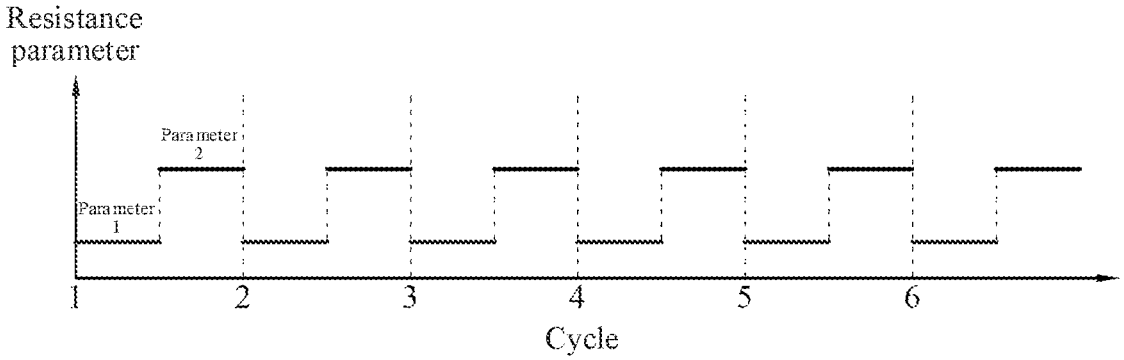
FIG. 8A is a schematic diagram of a fixed resistance parameter of a training device according to some embodiments.

In some embodiments, the lookup table may record a plurality of resistance parameters corresponding to a single section. Resistance parameters corresponding to a single section that are read by the controller 34 at different time points may be the same or different. FIG. 8A is a schematic diagram of a fixed resistance parameter of a training device according to some embodiments. The horizontal axis in FIG. 8A represents a quantity of cycles in the training process. Each time a closed trajectory is completed, a cycle is finished. The longitudinal axis represents a resistance outputted by the resistance generator 33. It is assumed that the closed trajectory is divided into two sections in half. The first section corresponds to a low outputted resistance and the second section corresponds to a high outputted resistance. Therefore, in the training process of the user, the controller 34 alternately reads the two resistance parameters respectively corresponding to the two sections in the lookup table, to adjust the output of the resistance generator 33. In this case, the single section and the resistance parameter are in a one-to-one correspondence.

Figure 8B:
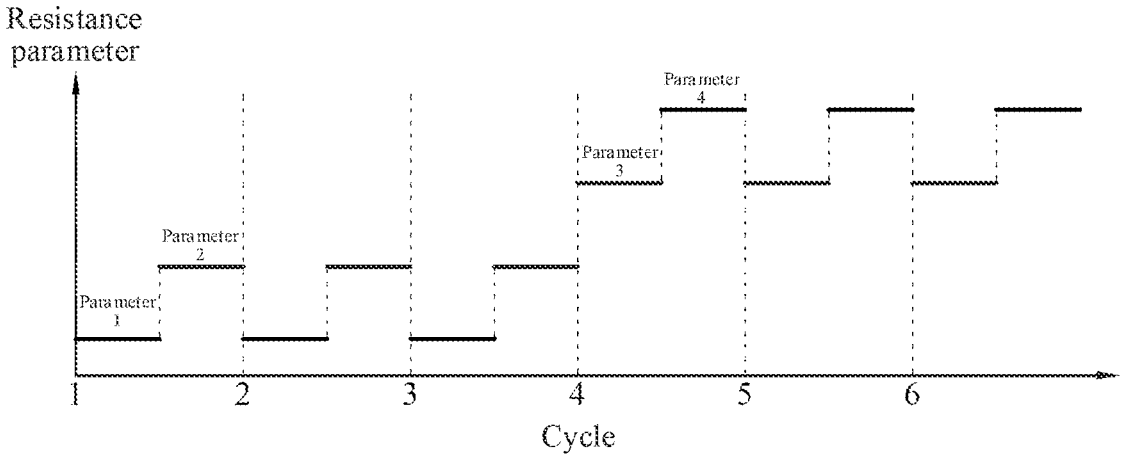
FIG. 8B is a schematic diagram of a variable resistance parameter of a training device according to some embodiments.

FIG. 8B is a schematic diagram of a variable resistance parameter of a training device according to some embodiments. It is assumed that the closed trajectory is divided into two sections in half. As can be seen in FIG. 8B, the first section corresponds to a resistance parameter 1 and the second section corresponds to a resistance parameter 2 in the first three cycles; and the first section corresponds to a resistance parameter 3 and the second section corresponds to a resistance parameter 4 in the last three cycles. Therefore, in the training process of the user, the controller 34 alternately reads the resistance parameter 1 and the resistance parameter 2 respectively corresponding to the two sections in the lookup table in the first three cycles, to adjust the output of the resistance generator 33; and the controller 34 alternately reads the resistance parameter 3 and the resistance parameter 4 respectively corresponding to the two sections in the lookup table in the last three cycles, to adjust the output of the resistance generator 33. In this case, the single section and the resistance parameter are in a one-to-two correspondence. In this embodiment, the controller 34 obtains a corresponding resistance parameter according to a section of a current location of the force receiving component 31 and a current cycle, and accordingly controls the resistance generator 33 to generate a corresponding resistance.

In some embodiments, the lookup table is arranged in a section order to store the resistance parameters, and then is sequentially read by the controller 34 according to the data arrangement order. For example, referring to FIG. 8A, it is assumed that the resistance parameter of the section 1 is 1 and the resistance parameter of the section 2 is 2. The lookup table is stored as [1,2]. In some embodiments, the lookup table may be arranged in a chronological order to store the resistance parameters, and then is sequentially read by the controller 34 according to the data arrangement order. For example, referring to FIG. 8B, it is assumed that the resistance parameter of the section 1 is 1 and the resistance parameter of the section 2 is 2 in the first three cycles, and the resistance parameter of the section 1 is 3 and the resistance parameter of the section 2 is 4 in the last three cycles. The lookup table is stored as [1,2,1,2,1,2,3,4,3,4,3,4]. In some embodiments, the lookup table may store a start point and an end point of a cycle, and then is sequentially read by the controller 34 according to the cycle order. For example, referring to FIG. 8B, the lookup table is stored as [1,1,2; 4,3,4]. The controller 34 searches for the cycle column in the lookup table, that is, the first column in the example, sequentially reads the array 1,2 from the first cycle, and sequentially reads the array 3,4 from the fourth cycle.

In view of the above, in some embodiments, to provide a plurality of training modes, the training device 3 may measure time by using a timer, to adjust the outputted resistance level at different time points. In some embodiments, the training device 3 may calculate the cycle by using a counter, to adjust the outputted resistance level in different cycles. For example, the training device 3 may provide a training mode in which the resistance level gradually increases with the cycle, to gradually strengthen the training intensity provided to the user.

Figure 9:
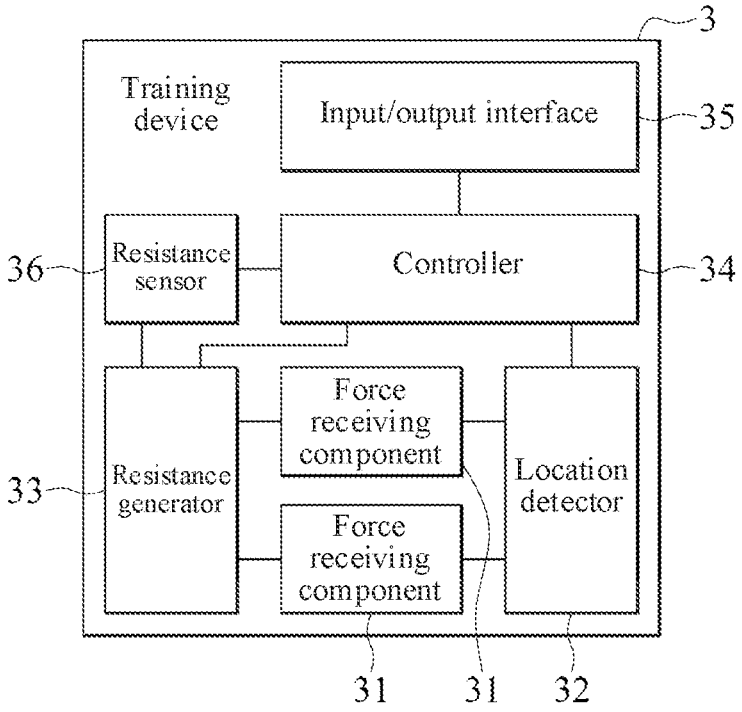
FIG. 9 is a block diagram of a training device having a resistance sensor according to some embodiments.

In some embodiments, the training device 3 includes a resistance sensor 36. FIG. 9 is a block diagram of a training device having a resistance sensor according to some embodiments. The input/output interface 35, the resistance sensor 36, the resistance generator 33, and the location detector 32 are coupled to the controller 34. The resistance generator 33 is coupled to the resistance sensor 36 and the force receiving component 31. The resistance sensor 36 is configured to measure a resistance value generated by the resistance generator 33, and the controller 34 controls, according to the resistance value, the resistance generator 33 to output a resistance corresponding to the resistance value. Referring to FIG. 1, the controller 34 adjusts the resistance outputted by the resistance generator 33, and an actual resistance value outputted by the resistance generator 33 may be measured by the resistance sensor 36 and fed back to the controller 34, thereby forming a closed loop control system. For example, in some embodiments, when the resistance generator 33 is a magnetic component, the controller 34 sets a current amount of an electromagnet to 1 ampere and expects the resistance generator 33 to output a resistance of 5 Newtons. When an actual resistance value generated by the resistance generator 33 measured by the resistance sensor 36 is 4 Newtons, the controller 34 increases the current amount of the electromagnet to reach the target of 5 Newtons.

In some embodiments, the training device 3 includes a force sensor 37. The force sensor 37 measures a force value on the force receiving component 31, and then transmits a force signal to the controller 34. In this embodiment, the controller 34 is configured to process the force signal to obtain force information. The controller 34 increases or reduces the resistance outputted by the resistance generator 33 according to the force information. The force sensor 37 may be, but is not limited to, a strain gauge, a piezoelectric sensor, a capacitive pressure sensor, a torque sensor, and the like. For example, referring to FIG. 4, a strain gauge is disposed on the pedal, and when a user pedals, a force value can be measured.

Figure 10:
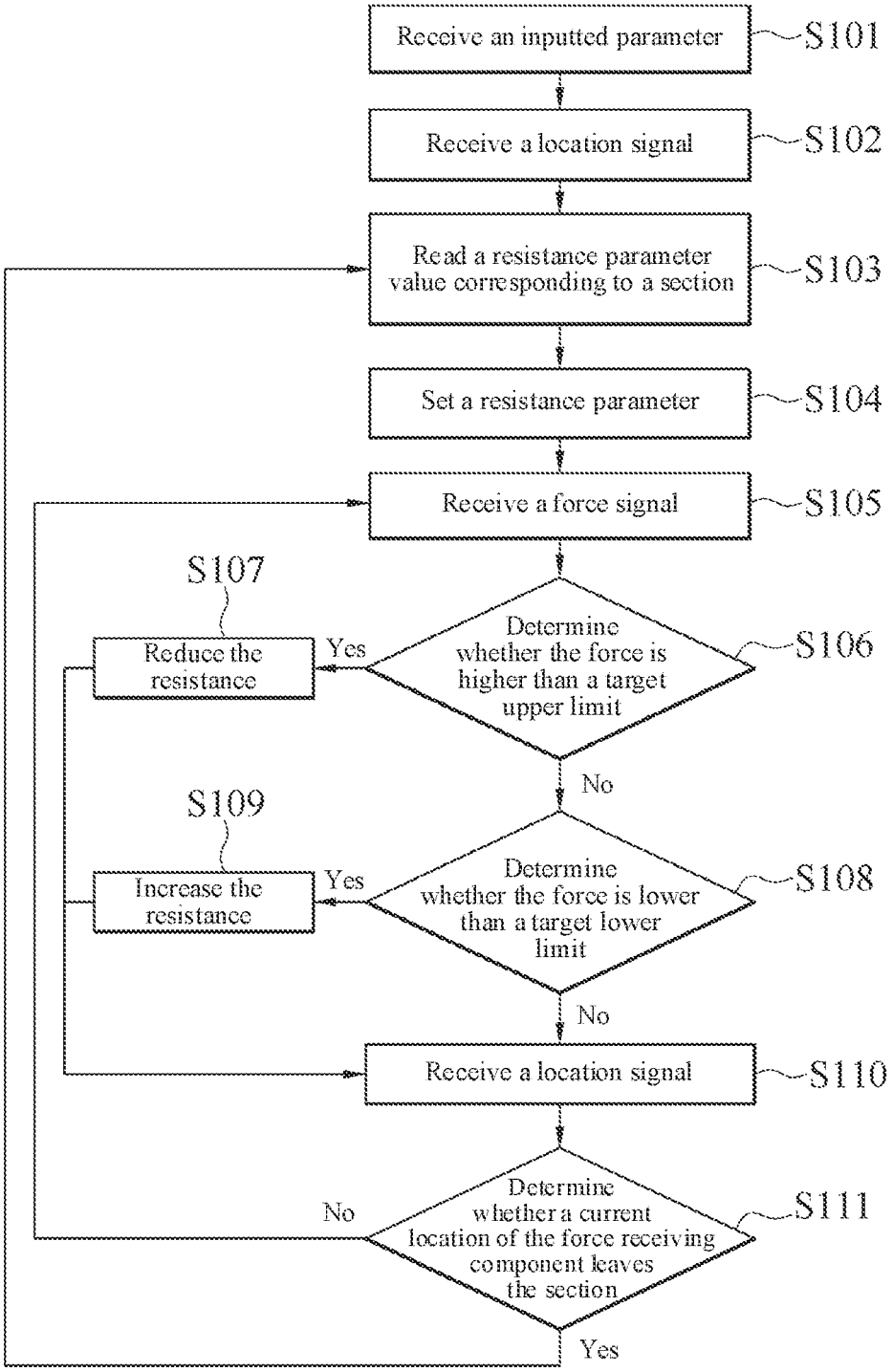
FIG. 10 is a flowchart of resistance adjustment based on an applied force in a training device according to some embodiments.

FIG. 10 is a flowchart of resistance adjustment based on an applied force in a training device according to some embodiments. In some embodiments, the controller 34 receives a set parameter inputted by a user (step S101), to adjust a setting of the training device 3. The training device 3 may allow the user to input a target parameter to set a force target range. After the setting is completed, the controller 34 receives a location signal that is about the force receiving component 31 and that is transmitted by the location detector 32 (step S102). The controller 34 determines a section of a current location of the force receiving component 31, reads a correspondence between sections and resistance parameters that is set by the user or that is preset, and obtains a corresponding resistance parameter according to the section of the current location (step S103). Then, the controller 34 adjusts the resistance generator 33 according to the resistance parameter, to change the resistance outputted by the resistance generator 33 (step S104). The controller 34 receives a force value on the force receiving component 31 that is measured by the force sensor 37 (step S105), and then accordingly determines whether the force applied by the user is higher than or equal to an upper limit of the force target range (step S106) and determines whether the force applied by the user is lower than or equal to a lower limit of the force target range (step S108). When the controller 34 determines that the force applied by the user is higher than or equal to the upper limit of the force target range (step S106), the controller 34 adjusts the resistance generator 33 to reduce the outputted resistance to a specific value or by a specific percentage (step S107). When the controller 34 determines that the force applied by the user is lower than or equal to the lower limit of the force target range (step S108), the controller 34 adjusts the resistance generator 33 to increase the outputted resistance to a specific value or by a specific percentage (step S109). When the controller 34 completes adjustment of the resistance generator 33 (step S107 or step S109) or determines that the force applied by the user is not higher than or equal to the upper limit of the force target range and not lower than or equal to the lower limit of the force target range, the controller 34 continues to receive the location signal that is about the force receiving component 31 and that is transmitted by the location detector 32 (step S110). When determining that the current location of the force receiving component 31 does not leave the foregoing section (step S111), the controller 34 continues to perform step S105; and when determining that the current location of the force receiving component 31 leaves the foregoing section (step S111), the controller 34 continues to perform step S103. The foregoing steps are not necessarily performed in sequence. For example, step S106 and step S108 are interchangeable in sequence.

In view of the above, in some embodiments, the training device 3 reduces the resistance outputted by the resistance generator 33 after the applied force is higher than the upper limit of the force target range, which may be used as a psychological incentive for the user to reach an expected force target range. In addition, muscles are composed of fast-twitch muscles and slow-twitch muscles, where the former can output a greater force in a short time but is easily fatigued, and the latter cannot output a great force in a short time but have greater sustained performance. The training device 3 can enable the user to apply a greater force in a short time in a specific section, and then reduce the resistance. An explosive force of fast-twitch muscles of a muscle group that dominates force application in the section is trained by using the high resistance in a short time, and fatigue of the fast-twitch muscles caused by a continuous high resistance is avoided.

In some embodiments, the training device 3 includes a speed sensor 38. The speed sensor 38 can measure a motion speed of the force receiving component 31 or a motion speed of the resistance generator 33 interlocked with the force receiving component 31. When the resistance generator 33 is interlocked with the force receiving component 31, the movement of the resistance generator 33 is substantially related to that of the force receiving component 31. Therefore, the motion speed of the resistance generator 33 measured by the speed sensor 38 would be substantially proportional to that of the force receiving component 31. The speed sensor 38 transmits a motion speed signal to the controller 34. In this embodiment, the controller 34 is configured to process the motion speed signal to obtain speed information. The controller 34 increases or reduces the resistance outputted by the resistance generator 33 according to the motion speed information. The speed sensor 38 may be, but is not limited to, a laser speed sensor, a Hall sensor, a rotational speed sensor, and the like. For example, referring to FIG. 4, a rotational speed sensor is disposed on the rear wheel. When the user pedals the pedal, the chain and the gear drive the rear wheel to rotate, so that a motion speed may be measured on the rear wheel.

Figure 11:
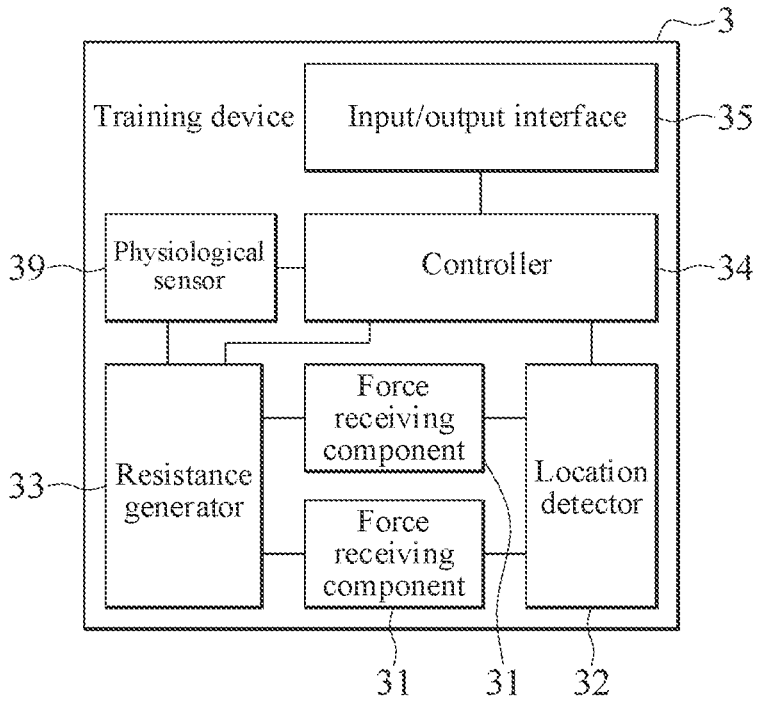
FIG. 11 is a block diagram of a training device having a physiological sensor according to some embodiments.

For some users, a physiological condition may change during single training. For example, muscles of a specific extremity of a user is fatigued and cannot effectively apply a force. For example, a user has an excessively heavy cardiopulmonary load and cannot bear the same training level any more. FIG. 11 is a block diagram of a training device having a physiological sensor according to some embodiments. The input/output interface 35, a physiological sensor 39, the resistance generator 33, and the location detector 32 are coupled to the controller 34. The resistance generator 33 is coupled to the physiological sensor 39 and the force receiving component 31. In some embodiments, the training device 3 includes the physiological sensor 39. In some embodiments, the physiological sensor 39 is a cardiopulmonary parameter sensor. The cardiopulmonary parameter sensor measures a cardiopulmonary parameter of the user, and then transmits a cardiopulmonary parameter signal to the controller 34. In this embodiment, the controller 34 is configured to process the cardiopulmonary parameter signal to obtain cardiopulmonary parameter information. The controller 34 increases or reduces the resistance outputted by the resistance generator 33 according to the cardiopulmonary parameter information. The cardiopulmonary parameter is a physiological parameter used for measuring a cardiac, vascular, or pulmonary function. For example, the cardiopulmonary parameter may be, but is not limited to, a heart rate, a blood pressure, blood oxygen, a respiratory frequency, a ventilatory capacity, or a parameter obtained through calculation based on the foregoing parameters. The cardiopulmonary parameter sensor may be, but is not limited to, a patch electrode, a photoelectric sensor, a respiratory monitor, a flow sensor, and the like. In some embodiments, a first cardiopulmonary threshold and a second cardiopulmonary threshold are set for the training device 3, where the first cardiopulmonary threshold is higher than the second cardiopulmonary threshold. The first cardiopulmonary threshold is used for defining whether a value of the cardiopulmonary parameter is excessively high, and the second cardiopulmonary threshold is used for defining whether a value of the cardiopulmonary parameter is excessively low. The first cardiopulmonary threshold and the second cardiopulmonary threshold may be used for defining a normal cardiopulmonary parameter range when the heart, the vessel, or the lung is in a normal or motion state. When the cardiopulmonary parameter is higher than or equal to the first cardiopulmonary threshold, the controller 34 controls the resistance generator 33 to reduce the resistance, and when the cardiopulmonary parameter is lower than or equal to the second cardiopulmonary threshold, the controller 34 controls the resistance generator 33 to increase the resistance. For example, in some embodiments, when the cardiopulmonary parameter is blood pressure, the first cardiopulmonary threshold may be set to the upper limit 120 mmHg of the normal blood pressure range, and the second cardiopulmonary threshold may be set to the lower limit 80 mmHg of the normal blood pressure range.

Referring to FIG. 11, in some embodiments, the physiological sensor 39 is a myoelectric sensor. The myoelectric sensor measures a muscle activation parameter of the user, and then transmits a muscle activation parameter signal to the controller 34. In this embodiment, the controller 34 is configured to process the muscle activation parameter signal to obtain muscle activation information. The controller 34 increases or reduces the resistance outputted by the resistance generator 33 according to the muscle activation information. The muscle activation parameter is a physiological parameter used for measuring an activation degree or a contraction capability of muscle tissue. For example, the muscle activation parameter may be, but is not limited to, an electric potential, a current, or a parameter obtained through calculation based on the foregoing parameters. In some embodiments, a muscle activation threshold is set for the training device 3 to define whether a value of the muscle activation parameter is excessively high. The muscle activation threshold may be used for defining an upper limit of a normal muscle activation parameter when the muscle is in a normal or motion state. When the muscle activation parameter is higher than or equal to the muscle activation threshold, the controller 34 controls the resistance generator 33 to reduce the resistance.

Figure 12A:
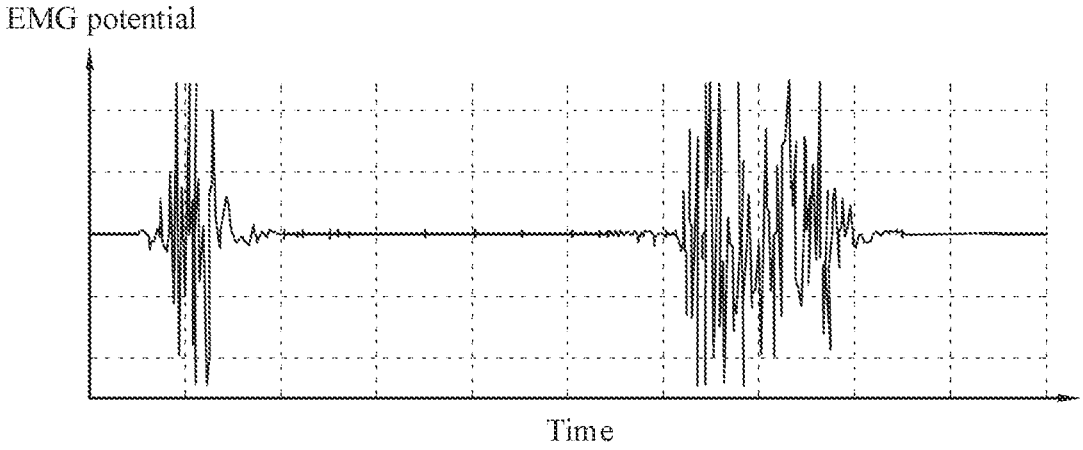
FIG. 12A is a schematic diagram of an electric potential generated by muscle contraction according to some embodiments.
Figure 12B:
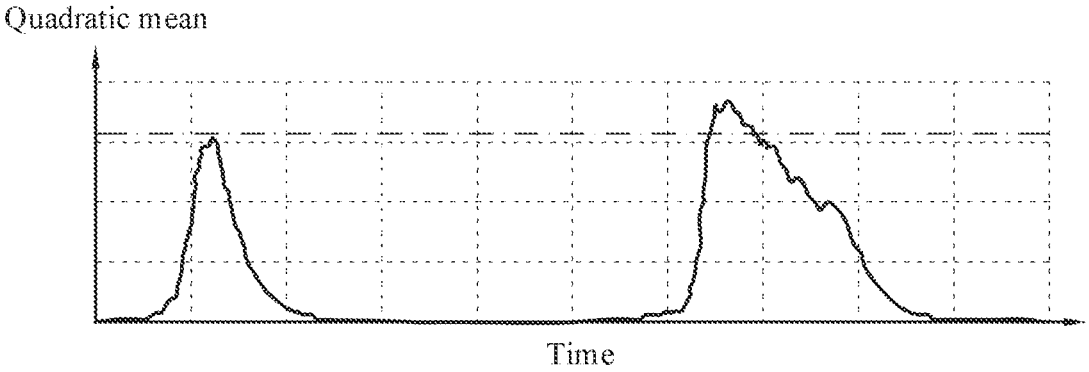
FIG. 12B is a schematic diagram of a quadratic mean obtained according to an electric potential in FIG. 12A.

FIG. 12A is a schematic diagram of an electric potential generated by muscle contraction according to some embodiments. FIG. 12B is a schematic diagram of a quadratic mean obtained according to an electric potential in FIG. 12A. Referring to FIG. 12A, the horizontal axis in FIG. 12A represents measurement time, and the longitudinal axis represents an electromyography potential. For example, a surface electrode is attached to the rectus femoris. During motion, the surface electrode can measure an electromyography (EMG) potential of the rectus femoris. Referring to FIG. 12B, the horizontal axis in FIG. 12B represents measurement time, and the longitudinal axis represents a quadratic mean of an EMG potential. A quadratic mean may be obtained through calculation by using the EMG potential in FIG. 12A. A muscle activation threshold may be set for the training device 3. When a value of the quadratic mean is higher than or equal to the muscle activation threshold, the controller 34 controls the resistance generator 33 to reduce the resistance.

Figure 13:
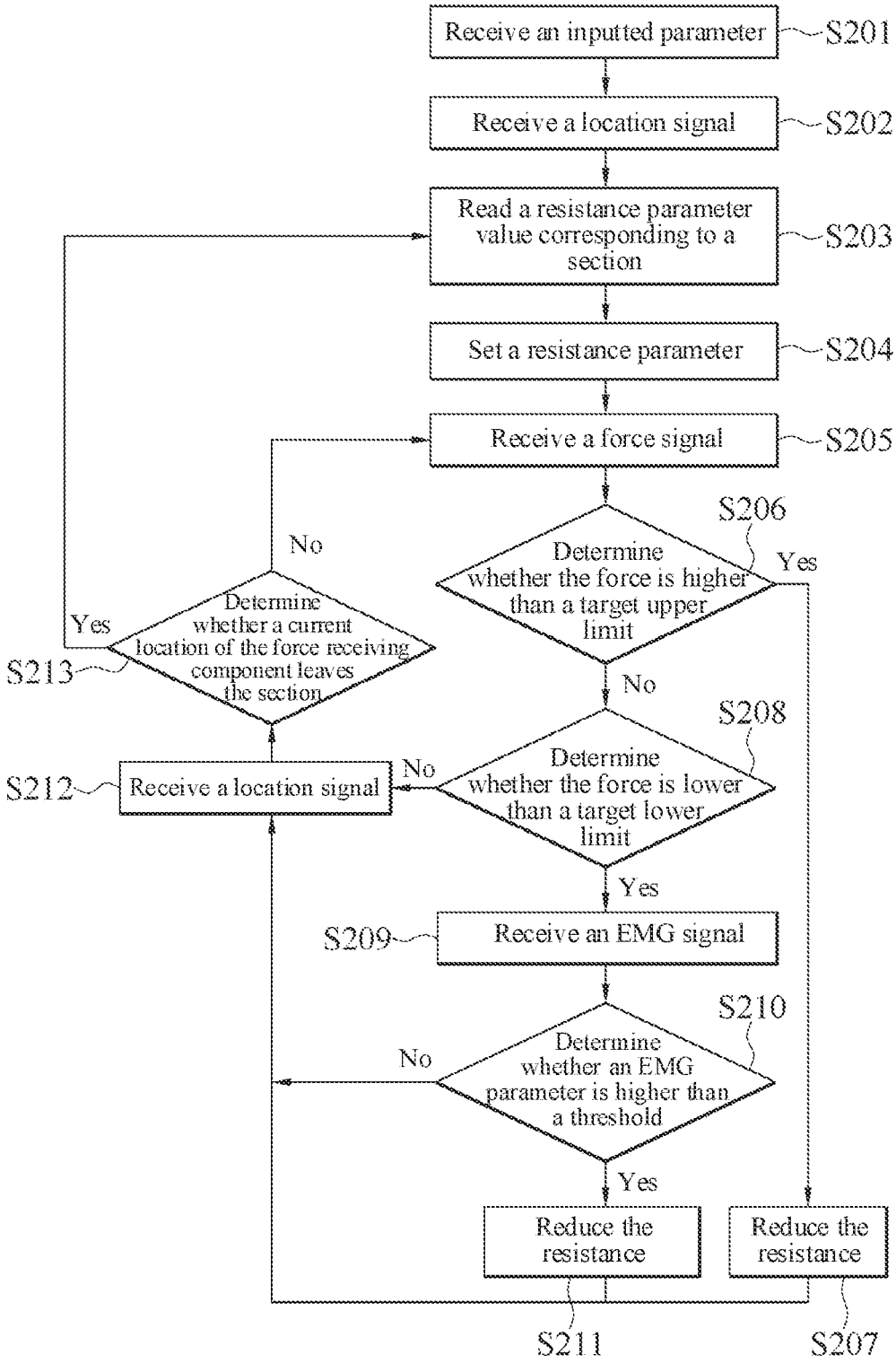
FIG. 13 is a flowchart of resistance adjustment based on an EMG potential in a training device according to some embodiments.

In some embodiments, the physiological sensor 39 is a myoelectric sensor, and the training device 3 includes both the myoelectric sensor and the force sensor 37. FIG. 13 is a flowchart of resistance adjustment based on an EMG potential in a training device according to some embodiments. In some embodiments, the controller 34 receives a set parameter inputted by a user (step S201), to adjust a setting of the training device 3. The training device 3 may allow the user to input a target parameter to set a force target range. After the setting is completed, the controller 34 receives a location signal that is about the force receiving component 31 and that is transmitted by the location detector 32 (step S202). The controller 34 determines a section of a current location of the force receiving component 31, reads a correspondence between sections and resistance parameters that is set by the user or that is preset, and obtains a corresponding resistance parameter according to the section of the current location (step S203). Then, the controller 34 adjusts the resistance generator 33 according to the resistance parameter, to change the resistance outputted by the resistance generator 33 (step S204). The controller 34 receives a force value on the force receiving component 31 that is measured by the force sensor 37 (step S205), and then accordingly determines whether the force applied by the user is higher than or equal to an upper limit of the force target range (step S206) and determines whether the force applied by the user is lower than or equal to a lower limit of the force target range (step S208). When the controller 34 determines that the force applied by the user is higher than or equal to the upper limit of the force target range (step S206), the controller 34 adjusts the resistance generator 33 to reduce the outputted resistance to a specific value or by a specific percentage (step S207). When the controller 34 determines that the force applied by the user is lower than or equal to the lower limit of the force target range (step S208), the controller 34 receives a muscle activation parameter of the user that is measured by the myoelectric sensor (step S209), and accordingly determines whether the muscle activation parameter of the user is higher than or equal to a muscle activation threshold (step S210). When the controller 34 determines that the muscle activation parameter of the user is higher than or equal to the muscle activation threshold (step S210), it indicates that the user has made the best of the muscle but cannot reach the lower limit of the force target range. In this case, the controller 34 adjusts the resistance generator 33 to reduce the outputted resistance to a specific value or by a specific percentage (step S211). When the controller 34 completes adjustment of the resistance generator 33 (step S207 or step S211) or determines that the force applied by the user is not higher than or equal to the upper limit of the force target range and not lower than or equal to the lower limit of the force target range, the controller 34 continues to receive the location signal that is about the force receiving component 31 and that is transmitted by the location detector 32 (step S212). When determining that the current location of the force receiving component 31 does not leave the foregoing section (step S213), the controller 34 continues to perform step S205; and when determining that the current location of the force receiving component 31 leaves the foregoing section (step S213), the controller 34 continues to perform step S203.

The foregoing steps are not necessarily performed in sequence. For example, step S206 and step S208 are interchangeable in sequence. For example, step S209 may be performed between step S205 and step S206. In some embodiments, some of the foregoing steps are not necessary provided that it can be determined whether the user has made the best of the muscle but cannot reach the lower limit of the force target range. For example, step S206 is ignored and step S207 is removed. For example, step S212 is ignored.

Referring to FIG. 11, in some embodiments, the physiological sensor 39 is a myoelectric sensor. The myoelectric sensor measures a muscle fatigue parameter of the user, and then transmits a muscle fatigue parameter signal to the controller 34. In this embodiment, the controller 34 is configured to process the muscle fatigue parameter signal to obtain muscle fatigue information. The controller 34 increases or reduces the resistance outputted by the resistance generator 33 according to the muscle fatigue information. The muscle fatigue parameter is a physiological parameter used for measuring a decrease in a muscle contraction force or a decrease in hold time of muscle contraction. For example, the muscle fatigue parameter may be, but is not limited to, an electric potential, a current, or a parameter obtained through calculation based on the foregoing parameters. In some embodiments, a muscle fatigue threshold is set for the training device 3 to define whether a value of the muscle fatigue parameter is excessively high. The muscle fatigue threshold may be used for defining an upper limit of a normal muscle fatigue parameter when the muscle is in a normal or motion state. When the muscle fatigue parameter is higher than or equal to the muscle fatigue threshold, the controller 34 controls the resistance generator 33 to reduce the resistance.

Figure 14A:
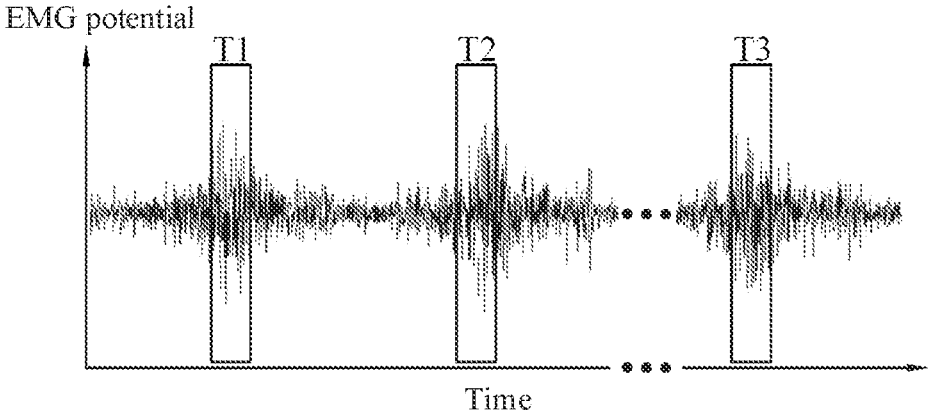
FIG. 14A is a schematic diagram of an electric potential generated by continuous muscle contraction according to some embodiments.
Figure 14B:
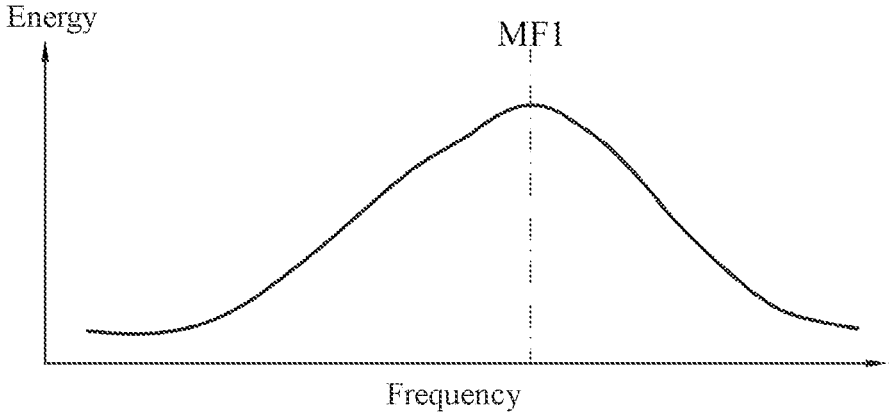
FIG. 14B is a schematic diagram of a frequency spectrum obtained according to an electric potential in a time range T1 in FIG. 14A.
Figure 14C:
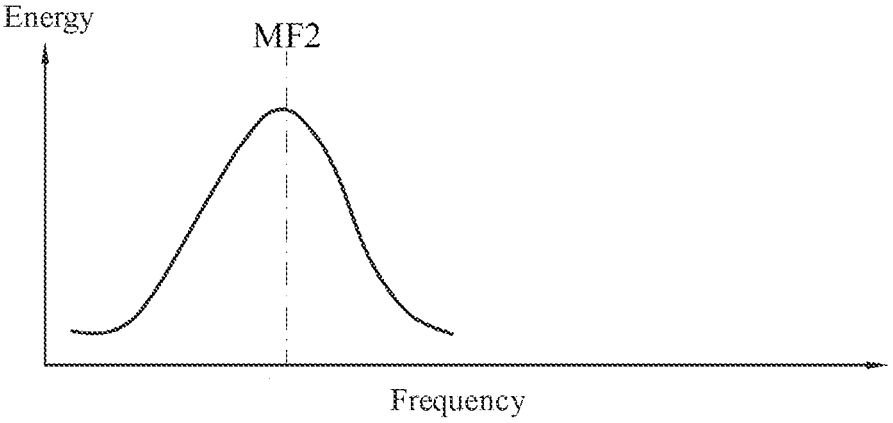
FIG. 14C is a schematic diagram of a frequency spectrum obtained according to an electric potential in a time range T3 in FIG. 14A.

FIG. 14A is a schematic diagram of an electric potential generated by continuous muscle contraction according to some embodiments. FIG. 14B is a schematic diagram of a frequency spectrum obtained according to an electric potential in a time range T1 in FIG. 14A. FIG. 14C is a schematic diagram of a frequency spectrum obtained according to an electric potential in a time range T3 in FIG. 14A. Referring to FIG. 14A, the horizontal axis in FIG. 14A represents measurement time, and the longitudinal axis represents an electromyography potential. For example, a surface electrode is attached to the rectus femoris. During motion, the surface electrode can measure an EMG potential of the rectus femoris. Referring to FIG. 14B, the horizontal axis in FIG. 14B represents a frequency, and the longitudinal axis represents a frequency spectrum energy. A median frequency of the frequency spectrum may be obtained through calculation by using the EMG potential in FIG. 14A. Fast-twitch muscles in muscles react quickly but easily get fatigued, so that the median frequency of the EMG potential frequency spectrum decreases after the fast-twitch muscles get fatigued. For example, a frequency band having a median frequency MF1 as shown in FIG. 14B is obtained after frequency spectrum conversion is performed on the EMG potential recorded in the time range T1 in an initial training period. After a period of training, a frequency band having a median frequency MF2 as shown in FIG. 14C is obtained after frequency spectrum conversion is performed on the EMG potential recorded in the time range T3. A movement from the median frequency MF1 to the median frequency MF2 represents a fatigue degree of the muscle, and therefore, a decrease in the median frequency is used as the muscle fatigue parameter. A muscle fatigue threshold may be set for the training device 3. When a value of the decrease in the median frequency is higher than or equal to the muscle fatigue threshold, the controller 34 controls the resistance generator 33 to reduce the resistance.

In some embodiments, the controller 34 receives a physiological parameter to adjust the first cardiopulmonary threshold, the second cardiopulmonary threshold, the muscle activation threshold, or the muscle fatigue threshold. The physiological parameter may be, but is not limited to, age, gender, height, weight, and the like.

What is claimed is:

1. A training device, comprising:

a force receiving component, moving along a closed trajectory;

a location detector, configured to detect a location of the force receiving component in the closed trajectory and to output a location signal;

a resistance generator, configured to exert a resistance on the force receiving component;

a controller, coupled to the resistance generator and the location detector, the controller controlling the resistance generator to adjust the resistance based on the location signal;

a force sensor, wherein the force sensor is configured to measure a force value on the force receiving component, and the controller controls the resistance generator to adjust the resistance according to the force value; and an input/output interface, configured to receive a target parameter set by a user, wherein the target parameter corresponds to an expected training amount;

wherein the closed trajectory comprises a plurality of sections, and the resistance generated by the resistance generator when the location signal corresponds to one section of the plurality of sections is different from the resistance generated by the resistance generator when the location signal corresponds to another section of the plurality of sections;

wherein the controller is configured to receive the target parameter and set a force target range corresponding to a specific one section of the plurality of sections according to the target parameter, and is further configured to determine whether the location signal corresponds to the specific one section of the plurality of sections; when the location signal corresponds to the specific one section of the plurality of sections, the controller controls the resistance generator to reduce the resistance when the force value is higher than or equal to an upper limit of a current force target range, and the controller controls the resistance generator to increase the resistance when the force value is lower than or equal to a lower limit of the current force target range.

2. The training device according to claim 1, wherein the controller is further configured to receive a set parameter; set the resistance corresponding to each section of the plurality of sections according to the set parameter; and adjust the resistance corresponding to the specific one section of the plurality of sections according to the force target range.

3. The training device according to claim 1, further comprising a memory, wherein the memory is configured to store a lookup table, the lookup table is used for recording a plurality of resistance parameters, the plurality of resistance parameters correspond to the plurality of sections, and the controller reads one of the plurality of resistance parameters corresponding to a section of the plurality of sections in which the force receiving component is located according to the lookup table, to adjust the resistance of the resistance generator.

4. The training device according to claim 3, wherein each section of the plurality of sections recorded in the lookup table corresponds to some of the plurality of the resistance parameters, and said resistance parameters are sequentially read by the controller.

5. The training device according to claim 1, further comprising a resistance sensor, wherein the resistance sensor is configured to measure a resistance value generated by the resistance generator, and the controller controls the resistance generator to adjust the resistance according to the resistance value.

6. The training device according to claim 1, further comprising a speed sensor, wherein the speed sensor is configured to measure a motion speed of the force receiving component or the resistance generator interlocked with the force receiving component, and the controller controls the resistance generator to adjust the resistance according to the motion speed.

7. The training device according to claim 1, further comprising a cardiopulmonary parameter sensor, wherein the cardiopulmonary parameter sensor is configured to measure a cardiopulmonary parameter, the controller controls the resistance generator to reduce the resistance when the cardiopulmonary parameter is higher than or equal to a first cardiopulmonary threshold, and the controller controls the resistance generator to increase the resistance when the cardiopulmonary parameter is lower than or equal to a second cardiopulmonary threshold.

8. The training device according to claim 7, further comprising a myoelectric sensor, wherein the myoelectric sensor is configured to measure a muscle activation parameter, and the controller controls the resistance generator to reduce the resistance when the muscle activation parameter is higher than or equal to a muscle activation threshold.

9. The training device according to claim 8, further comprising a force sensor, wherein the force sensor is configured to measure the force value on the force receiving component, the controller is configured to receive the target parameter and set the current force target range according to the target parameter, and the controller determines whether the muscle activation parameter is higher than or equal to the muscle activation threshold when the force value is lower than or equal to a lower limit of the current force target range.

10. The training device according to claim 9, wherein the myoelectric sensor is further configured to measure a muscle fatigue parameter, and the controller controls the resistance generator to reduce the resistance when the muscle fatigue parameter is higher than or equal to a muscle fatigue threshold.

11. The training device according to claim 10, wherein the controller receives a physiological parameter to adjust the first cardiopulmonary threshold, the second cardiopulmonary threshold, the muscle activation threshold, or the muscle fatigue threshold.

12. The training device according to claim 1, wherein the resistance generator is a friction resistance generator or an electromagnetic resistance generator.

13. The training device according to claim 1, wherein the closed trajectory is circular.

14. The training device according to claim 1, wherein the training device comprises another force receiving component, each of the force receiving components comprises a pedal component moving along the closed trajectory, which is a circular closed trajectory, and the closed trajectory comprises the plurality of sections;

the location detector is configured to detect the location of one of the force receiving components and to output the location signal;

the resistance generator is configured to exert the resistance on the force receiving components, wherein the resistance generator is a friction resistance generator or an electromagnetic resistance generator; and the resistance generated by the controller controlling the resistance generator is different when the location of the force receiving components are respectively located in two of the sections.

* * * * *